US005376951A

United States Patent [19]

Inoue et al.

[11] Patent Number: 5,376,951

[45] Date of Patent: Dec. 27, 1994

[54] THERMAL TRANSFER PRINTER AND RIBBON CASSETTE FOR USE IN THE SAME

[75] Inventors: Ikutaro Inoue, Takizawa; Yuki Ohishi, Tamayama, both of Japan

[73] Assignee: Alps Electric Co., Ltd., Tokyo, Japan

[21] Appl. No.: 865,717

[22] Filed: Apr. 8, 1992

Related U.S. Application Data

[63] Continuation of Ser. No. 497,460, Mar. 22, 1990, abandoned.

[30] Foreign Application Priority Data

Jun. 7, 1989 [JP] Japan ..... 1-144576

[51] Int. Cl.[5] ..... B41J 32/00; B41J 33/04; B41J 33/14

[52] U.S. Cl. ..... 346/76 PH; 400/207; 400/208; 400/208.1; 400/235; 400/236

[58] Field of Search ..... 400/207, 208, 208.1, 400/225, 227, 235, 235.1, 236, 236.1, 236.2, 695, 120; 346/76 PH

[56] References Cited

U.S. PATENT DOCUMENTS

| | | | |
|---|---|---|---|
| 4,408,908 | 10/1983 | Applegate et al. | 400/235.1 |
| 4,732,500 | 3/1988 | Burgin | 400/235.1 |
| 4,772,144 | 9/1988 | Weed | 400/235.1 |
| 5,030,967 | 7/1991 | Inoue et al. | 400/207 |

FOREIGN PATENT DOCUMENTS

| | | | |
|---|---|---|---|
| 0126203 | 11/1984 | European Pat. Off. . | |
| 0164488 | 12/1985 | European Pat. Off. | 400/235.1 |
| 0184686 | 10/1984 | Japan | 400/235.1 |
| 0063187 | 4/1985 | Japan | 400/235.1 |
| 0055183 | 3/1987 | Japan | 400/235.1 |
| 0290570 | 12/1987 | Japan | 400/235.1 |
| 0054276 | 3/1988 | Japan | 400/235.1 |
| 2221653 | 2/1990 | United Kingdom . | |

OTHER PUBLICATIONS

Applegate et al, "Motor Drive Arrangement for Ribbon Feed and Printhead Positioning Control", IBM Technical Disclosure Bulletin, vol. 25, No. 11B, Apr. 1983, pp. 6236–6238.

Molloy et al, "Motor Driven Ribbon Take-Up", IBM Bulletin, vol 27, No. 1B, Jun. 1984, pp. 900–901.

*Primary Examiner*—Benjamin R. Fuller
*Assistant Examiner*—Huan Tran
*Attorney, Agent, or Firm*—Guy W. Shoup; Patrick T. Bever

[57] ABSTRACT

A thermal transfer printer in which printing is performed by melting ink from an ink ribbon and transferring the molten ink to a printing sheet, and which is capable of erasing printed characters as desired by attaching the transferred ink to the ink ribbon and drawing the ink ribbon to separate the ink from the printing sheet. At least one ribbon feed roller having its surface formed of a material of a large friction coefficient is provided in a ribbon cassette housing the ink ribbon. The ribbon feed roller is rotated by a drive shaft provided on a carriage to assist in separating the ink ribbon from the printing sheet, thereby enabling the ink ribbon to be separated and wound up constantly with stability during each of the printing and correction operations.

3 Claims, 5 Drawing Sheets

THERMAL TRANSFER PRINTER AND RIBBON CASSETTE FOR USE IN THE SAME

This is a continuation of application Ser. No. 07/497,460, filed Mar. 22, 1990, abandoned.

BACKGROUND OF THE INVENTION

1. Field of the Invention

This invention relates to a thermal transfer printer for printing characters based on selectively heating exothermic elements of a thermal head so that ink of an ink ribbon is partially melted and transferred to a sheet of paper or other media (printing sheet) and, more particularly, to a thermal transfer printer in which an ink ribbon housed in a ribbon cassette is made to travel with stability, as well as to a ribbon cassette which enables the ink ribbon to travel with stability.

2. Description of the Related Art

Ordinarily, a thermal transfer printer has a construction in which a carriage is disposed on the front side of a platen so as to be reciprocatively movable along the platen, and a thermal head, capable of contacting the platen, and a ribbon cassette, housing an ink ribbon, are mounted on the carriage, the ink ribbon being lead out of an opening in the ribbon cassette so that an exposure section is positioned between the thermal head and a printing sheet placed between the ink ribbon and the platen.

In this type of thermal transfer printer, the ribbon cassette has a pair of rotatable bobbins around which the ink ribbons are wound from its extreme ends, and one of these bobbins serves as a draw-out bobbin from which the ribbon is drawn out of the ribbon cassette, while the other serves as a windup bobbin for winding up a portion of the ink ribbon used for printing.

In conventional printers, the wind-up bobbin is connected through a friction member, such as a felt member, to a rotary member which is driven by a motor mounted on the carriage or is moved based on the traveling of the carriage.

In this arrangement, during printing, the ink pinched between the thermal head and printing sheet is unwound from the draw-out bobbin and is successively used for printing as the carriage travels, and the portion of the ink ribbon separated from the printing sheet after being used for printing is wound up around the windup bobbin which is friction-connected to the rotary member.

However, in the case where the ink ribbon, separated from the printing sheet, is wound up by only the windup bobbin friction-connected to the rotary member as described above, the force of winding up the ink ribbon is changed with the change in the outside diameter of the portion the ink ribbon wound around the windup bobbin.

That is, as the outside diameter of the portion of the ink ribbon wound around the windup bobbin increases, the torque also increases so that the ink ribbon winding force becomes greater. It is therefore impossible to make the ink ribbon winding up force uniform. When the winding force is small, there is a risk of failure to separate the ink ribbon from the printing sheet with stability, or a risk of the ink ribbon being entangled, resulting in failure to perform printing of good quality with stability.

SUMMARY OF THE INVENTION

In view of these problems, an object of the present invention is to provide a thermal transfer printer and a ribbon cassette for use in the printer in which the printer and cassette enable the ink ribbon to be wound up by a constant winding force, thereby enabling the printer to perform printing of good quality with stability.

Another object of the present invention is to provide a thermal transfer printer having a carriage on which a thermal head and a ribbon cassette housing an ink ribbon are mounted, the thermal head being capable of reciprocatively moving along a platen and capable of being moved away from or closer to the platen, the ink ribbon being lead out of the ribbon cassette so that an exposed section is positioned between the thermal head and a printing sheet disposed between the ink ribbon and the platen, the thermal transfer printer including at least one roller drive shaft driven and rotated by a driving source projecting from the carriage, the roller drive shaft being fitted to a ribbon feed roller provided in the ribbon cassette to make the ink ribbon travel based on a frictional force.

A still another object of the present invention is to provide a ribbon cassette housing an ink ribbon in which separate ends of the ink ribbon are wound around a pair of rotatable bobbins and an intermediate section of the ink ribbon is exposed on the outside of the ribbon cassette, the ribbon cassette including a ribbon feed roller having a surface facing a ribbon path formed between the pair of bobbins and contacting the ink ribbon, the surface of the ribbon feed roller being formed of a material having a large friction coefficient, the ribbon feed roller being capable of being connected to an external driving source.

A further object of the present invention is to provide a ribbon cassette having a construction based on the construction of the above ribbon cassette, the surface of the ribbon feed roller being covered with rubber in the form of blocks arranged checkerwise.

In the thermal transfer printer and the ribbon casette having the above constructions, the roller drive shaft projecting from the carriage is fitted to the ribbon feed roller of the ribbon cassette to transmit the rotation of the roller drive shaft to the ribbon feed roller, thereby enabling the ink ribbon to be supplied at a constant speed with stability by virtue of the material of the ribbon feed roller having a large friction coefficient. It is therefore possible to constantly separate the ink ribbon from the printing sheet with stability and, hence, to perform printing of good quality.

The ribbon cassette having the ribbon feed roller having its surface covered with rubber in the form of checker blocks is free from influence of dust or extraneous substances and ensures that the ribbon can be wound up with further improved stability.

DETAILED DESCRIPTION OF THE PREFERRED EMBODIMENTS

The present invention will be described below with respect to an embodiment illustrated in the accompanying drawings.

Figure 3:
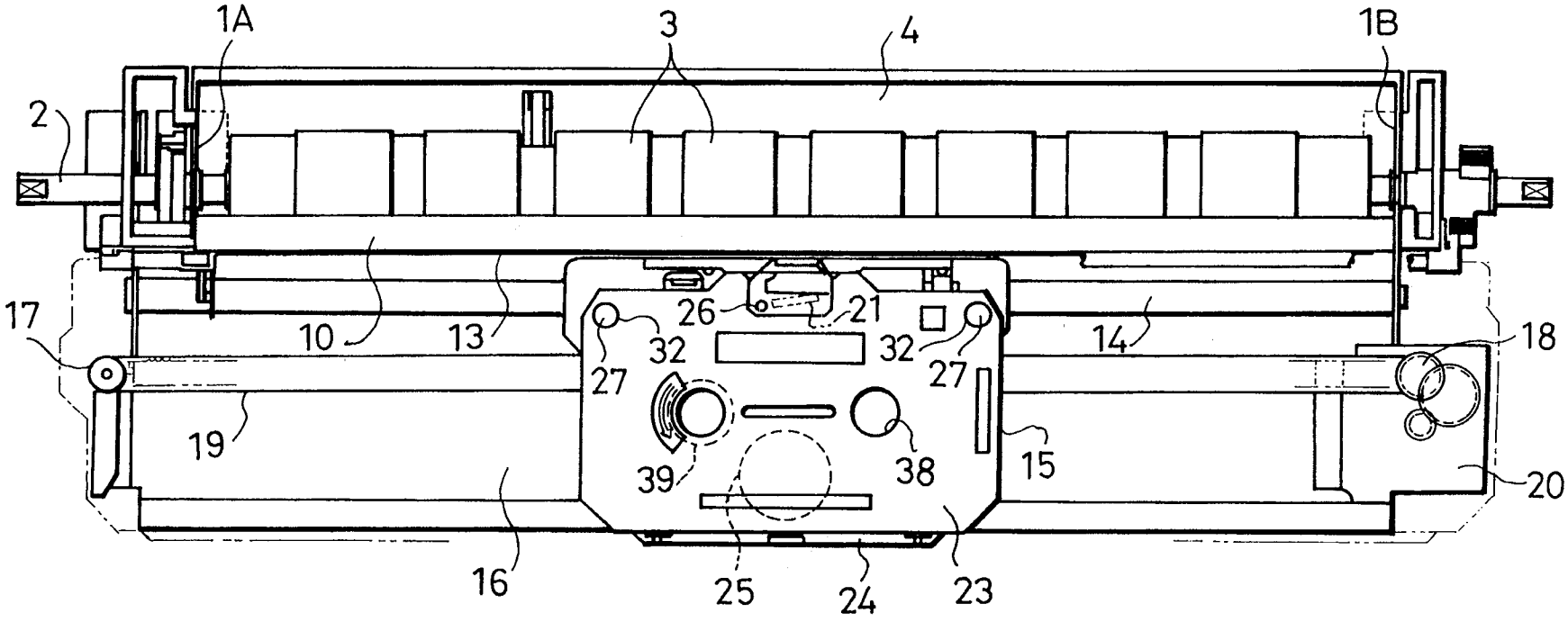
FIG. 3 is a plan view of the thermal transfer printer in accordance with the present invention, showing essential portions thereof.
Figure 4:
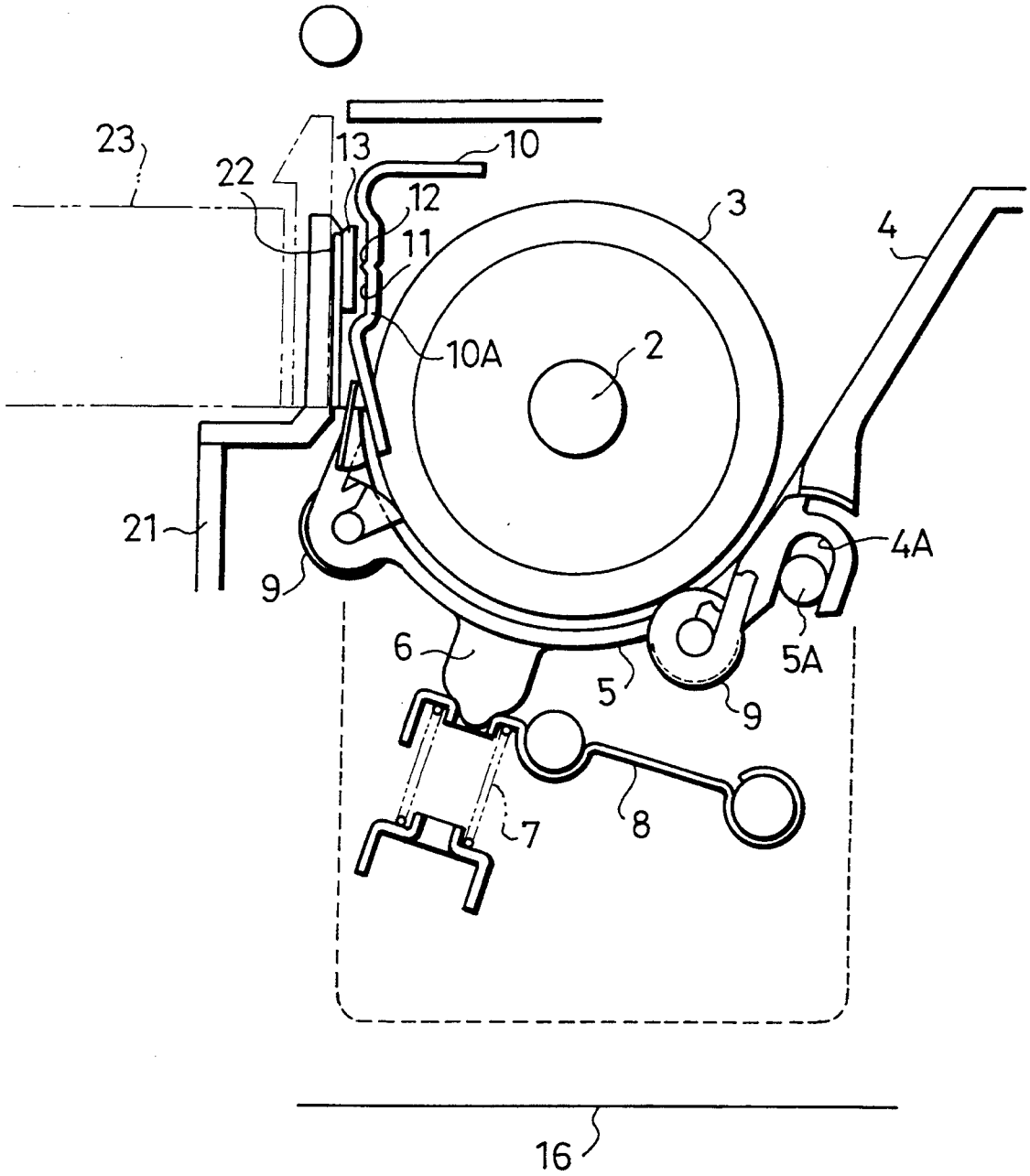
FIG. 4 is an enlarged right side view of the essential portions shown in FIG. 3.

FIGS. 3 and 4 show a thermal transfer printer having a ribbon cassette in accordance with the present invention. In this embodiment, the thermal printer is of a typewriter type and is capable of performing a correction operation for erasing a character or the like printed on a sheet of paper or other media (printing sheet) by removing the printed ink from the printing sheet.

A rotary shaft 2 driven by an unillustrated motor is rotatably supported on left and right frames 1A and 1B of this thermal transfer printer, and a plurality of rubber rollers 3, 3 . . . are fitted on the rotary shaft 2 while being spaced apart from each other in the axial direction. A stationary guide member 4 for inserting an unillustrated printing sheet under the rubber rollers 3 is disposed in an inclined position at the rear of the rubber rollers 3, and a movable guide member 5 having a circular-arc cross-sectional shape is disposed under the rubber rollers 3 so as to be movable away from or closer to the rubber rollers 3 based on sliding a guide pin 5A projecting from the movable guide member 5 in a guide groove 4A formed in the stationary guide member 4. A holder 6 is protrusively formed on a back surface of the movable guide member 5, and a lever 8 urged by a spring 7 is pressed against and maintained in contact with the holder 6. A pair of small-diameter feed rollers 9, 9 are rotatably supported on the movable guide member 5 while being spaced apart from each other in the circumferential direction of the rubber rollers 3 so as to slightly project on the side of the rubber rollers 3. Consequently, the movable guide member 5 is maintained by the resiliency of the spring 7 so as to face the outer circumferences of the rubber rollers 3 while being spaced therefrom by a very small distance, with the feed rollers 9 pressed against and maintained in contact with the rubber rollers 3.

A platen base plate 10 having a generally L-shaped cross-sectional shape and extending horizontally is supported on the two frames 1A and 1B while being positioned on the front side of the rotary shaft 2. A lower end portion of an upright portion 10A of the platen base plate 10 is forked, extends obliquely so that its portion closer to its lower end is closer to the rotary shaft 2, and is loosely fitted between an adjacent pair of rubber rollers 3. A recess 11 laterally facing and extending in the horizontal direction is formed in the surface of the upright portion 10A of the platen base plate 10 at the vertical-direction center thereof which surface does not face the feed rollers 9, and a protrusion wall 12 extending in the horizontal direction is formed on the bottom surface of the recess 22 at the vertical-direction center thereof. A rubber platen 13 in the form of a flat plate is supported on the two frames 1A and 1B. The platen 13 is loosely fitted in the recess 11, has its back surface brought into contact with the protrusion wall 12, and is rotatable in a vertical plane.

A carriage shaft 14, extending parallel to the axial direction of the feed rollers 9, is supported on the frames 1A and 1B on the front side of the feed rollers 9, and a carriage 15 reciprocatively movable in the axial direction of the carriage shaft 14 is supported on the carriage shaft 14. A driven gear 17 and a drive gear 18 are rotatably supported on a printer base plate 16 in the vicinity of the frames 1A and 1B while being spaced apart from each other in the direction of movement of the carriage 15. A timing belt 19, having its two ends attached to the carriage 15, is wrapped around the driven gear 17 and the drive gear 18. A driving motor 20, for driving the drive gear 18, is provided on the printer base plate 16. The driving motion of the driving motor 20 is transmitted to the drive gear 18 after being reduced in speed, and the carriage 15 can be reciprocatively moved along the carriage shaft 14 by being driven with the driven gear 18 through the traveling of the timing belt 19.

A thermal head mount 21, facing the platen 13, is supported on the carriage 15 so as to be movable away from or closer to the platen 13. A thermal head 22, capable of being moved away from or closer to the platen 13, is mounted on the thermal head mount 21. The thermal head 22 has a plurality of exothermic elements which are aligned with each other and which are selectively made to develop heat in accordance with printing information input through an unillustrated keyboard. A cassette mount portion 24, on which a ribbon cassette 23 is placed, is formed on the carriage 15. A portion of an ink ribbon drawn out of the ribbon cassette is lead over the cassette mount portion 24 and is positioned between the platen 13 and the thermal head 22. A motor 25, for moving the thermal head mount 21 to move the thermal head 22 away from or closer to the platen 13, and for winding the ink ribbon 40 described later with reference to FIGS. 2(A) and 2(B) around a later-mentioned windup bobbin 39 of the ribbon cassette 23, is mounted on the carriage 15. A correction pin 26 is movably disposed on the carriage 15 in the vicinity of the thermal head mount 21. The correction pin 26 can be moved away from or closer to platen 13 at the rear of the thermal head 22 with respect the direction of traveling of the carriage 15 (the rightward direction as viewed in FIG. 3) at the time of printing or correction.

Figure 1:
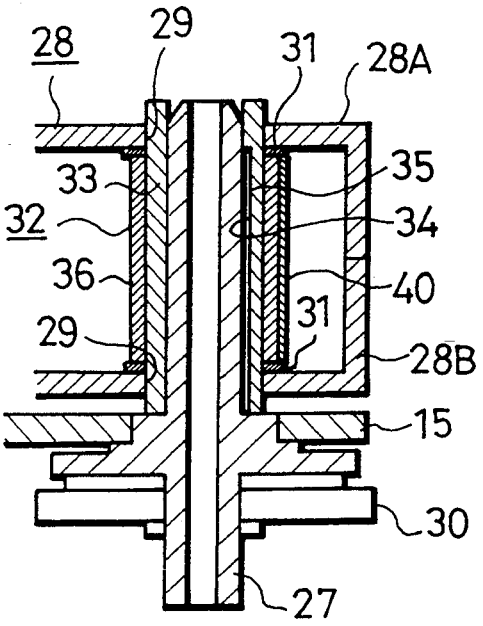
FIG. 1 is a longitudinal cross-sectional view of a thermal transfer printer and a ribbon cassette which represent an embodiment of the present invention, showing essential portions thereof.
Figure 2A:
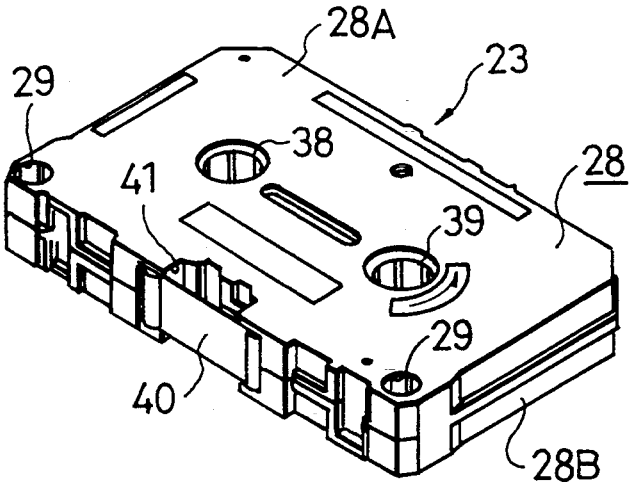
FIGS. 2(A) and 2(B) are a perspective view and an exploded perspective view of the ribbon cassette.
Figure 2B:
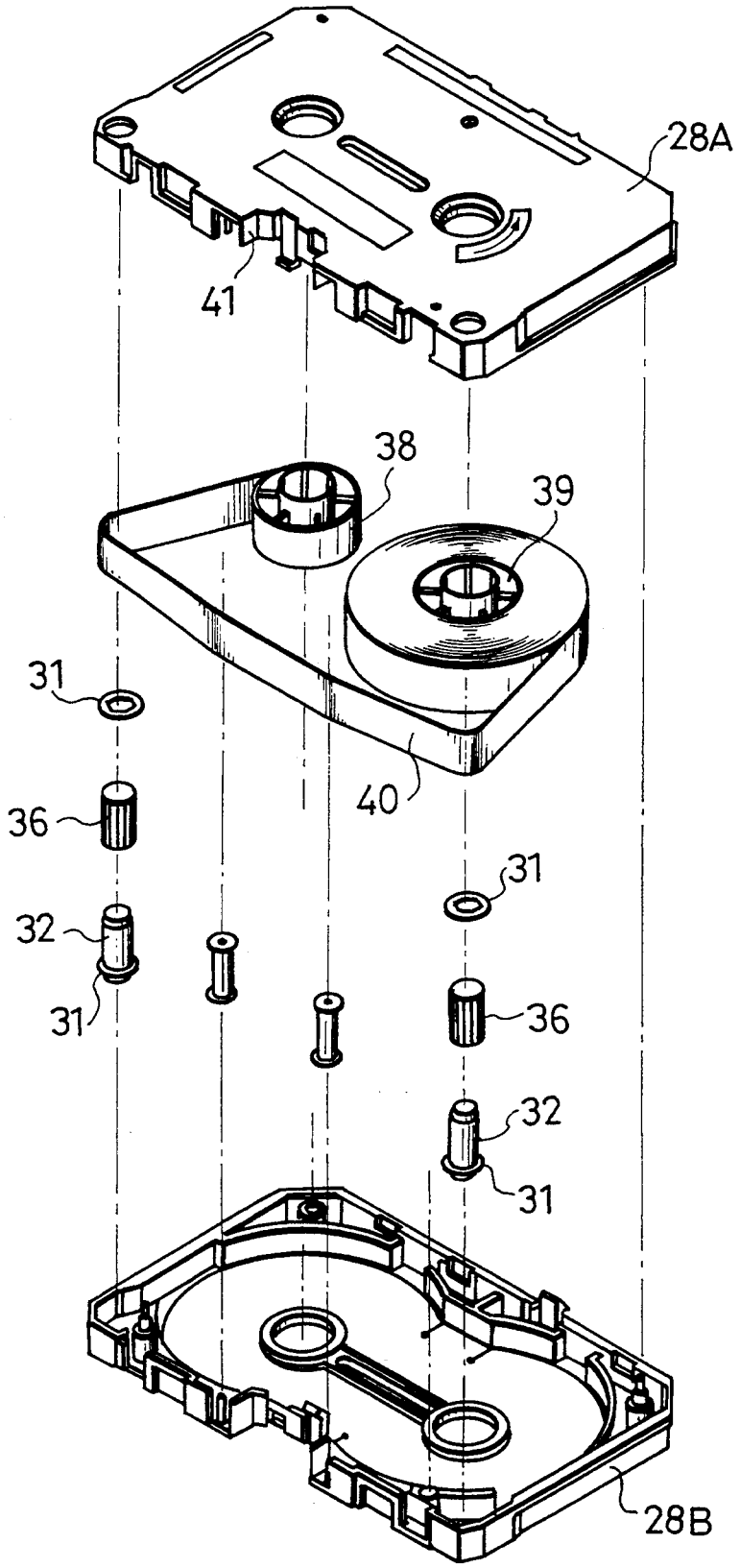

Roller drive shafts 27 extending in the vertical direction, details of which (one of which) are illustrated in FIG. 1, are rotatably supported on the carriage 15 at the front and rear ends thereof with respect to the direction of traveling of the carriage 15 at the time of printing or correction. The roller drive shafts 27 are fitted in pairs of circular holes 29, 29 coaxially formed in front corner portions of upper and lower walls 28A and 28B of a casing 28 of the ribbon cassette 23, as shown in FIGS. 2(A) and 2(B) in detail.

Each roller drive shaft 27 extends so as to project downward out of the carriage 15, and a gear 30 is connected to a portion of the roller drive shaft 27 below the carriage 15. The gear 30 is connected to the motor 25 by an unillustrated special gear train and is driven for rotation by the driving of the motor 25. Sleeves 33, 33 of a pair of ribbon feed rollers 32, 32 are disposed in the casing 28 of the ribbon cassette 23 in such a manner that upper and lower end portions of the sleeves 33 are rotatably supported by being inserted in the circular holes 29 of the upper and lower walls 28A and 28B with washers 31 interposed therebetween. A plurality of key grooves 34, 34 . . . are formed in inner circumferential surfaces of the sleeves 33 while being spaced apart from each other in the inner circumferential direction. On the other hand, a plurality of keys 35, 35 . . . capable of being fitted to the key grooves 34 are protrusively formed on outer circumferential surfaces of the roller drive shafts 27. The sleeves 33 are rotatable integrally with the roller drive shafts 27 by being fitted to the same.

Cover sleeves 36, formed of a material such as a rubber having a comparatively large friction coefficient, are attached to the outer circumferential surfaces of the sleeves 33 of the ribbon feed rollers 32. The whole of the outer circumferential surface of each cover sleeves 36 is formed with a plurality of protrusions or recesses extending in the axial direction to increase the frictional force. A draw-out bobbin 38 and the windup bobbin 39 are rotatably supported in the ribbon cassette 23, and the ribbon is wound around the draw-out bobbin 38 and the windup bobbin 39 from its extreme ends. A recess 41 in which the thermal head 22 is positioned, is formed in the casing 28 of the ribbon cassette 23 on the side where the cassette 23 faces the platen 13. A portion of the ink ribbon 40 housed in the ribbon cassette 23 is lead to the recess 41. The ink ribbon 40 is guided from the draw-out bobbin 38 to a point in front of the head thermal 22 along the outer circumference of the cover sleeve 36 on one of the ribbon feed rollers 32, and is supplied to the windup bobbin 39 along the outer circumference of the cover sleeve 36 on the other ribbon feed roller 32 to be wound around the windup bobbin 39.

The operation of the thus-constructed embodiment will be described below.

When the ribbon cassette 23 is placed on the ribbon cassette mount portion 24 of the carriage 15, the exposed portion of the ink ribbon 40 in the recess 41, formed in the front portion of the ribbon cassette 23, is positioned in front of the thermal head 22, while the roller drive shafts 27, projecting from the carriage 15 above the thermal head mount 21, are inserted into the sleeves 33 on the ribbon feed rollers 32 through the circular holes 29 formed in the lower wall 28B of the ribbon cassette 23 so that the key grooves 34 of the sleeves 33 are fitted to the keys 35 of the roller drive shafts 27, thereby rendering the sleeves 33 rotatable integrally with the roller drive shafts 27.

In this state, printing is performed like a typewriter on a printing sheet supplied in front of the platen 13 by the rotation of the rotary shaft 2 driven by the unillustrated motor. To perform printing, printing information is input through the unillustrated keyboard, and the motor 25 mounted on the carriage 15 is energized pulsatively each time a set of printing information is input to move the thermal head mount 21 toward the platen 13, so that the thermal head 22 is pressed against the platen 13 with the ink ribbon 40 and the printing sheet interposed therebetween. At this time the platen 13 is positioned so as to closely contact the thermal head 22, because it is rotatable in a vertical plane. While the thermal head 22 is being pressed against the platen 13 with the ink ribbon 40 and the printing sheet interposed therebetween, the exothermic elements of the thermal head 22 are selectively made to develop heat in accordance with the input printing information so as to melt the ink of the portion of the ink ribbon 40 in contact with the heat-developing exothermic elements and to transfer the molten ink to the printing sheet. Thereafter, the driving motor 20 is pulsatively energized so that the carriage 15 is moved along the carriage shaft 14 in accordance with the spacing set between characters based on the traveling of the timing belt 19 to be set to a position for the operation corresponding to the next input. The motor 25 is driven to rotate in one direction in synchronism with this movement of the carriage 15, the driving torque of the motor 25 is transmitted roller drive shafts 27 through the unillustrated special gear train, and the ribbon feed rollers 32 are thereby rotated at a constant speed, so that the ink ribbon 40 is drawn out from the draw-out bobbin 38 by the frictional force of the cover sleeve 36 located on the upstream side of the thermal head 22, while a portion of the ink ribbon used for printing with the thermal head 22 is tensioned by the frictional force of the cover sleeve 36 on the downstream side of the thermal head 22 so as to be separated from the printing sheet. The portion of the ink ribbon 40 separated from the printing sheet is wound around the windup bobbin 39 by being supplied via the outer circumference of the ribbon feed roller 32. In principle, the thermal head 22 is moved apart from the platen 13 for each input operation because the thermal transfer printer is of the typewriter type. However, the thermal head 22 may be maintained in a state such as to be pressed against the platen 13 in a case where the input is supplied at a high speed or supplied continuously.

As described above, printing is performed in accordance with the printing information input through the keyboard. After printing for one line has been completed, the carriage 15 is returned by driving of the drive motor 20 in the direction opposite to that of the previous driving, while the thermal head 22 is spaced apart from the platen 13. At this time the rotary shaft 2 is driven to rotate by the driving of the unillustrated motor to move the printing sheet the distance of one line of text. Then, the next printing information is input through the keyboard to print the next line.

To perform a correction operation for removing the ink attached to a certain portion of the printing sheet, the printing sheet and the carriage 15 are moved so that a character which is printed on the printing sheet, and which is to be erased, faces the thermal head 22. The motor 25 mounted on the carriage 15, is thereafter driven to press the thermal head 22 and the correction pin 26 against the platen 13 with the ink ribbon 40 and the printing sheet interposed therebetween. The exothermic elements of the thermal head 22 are then made to develop heat to melt the ink with which the printed character to be erased is formed on the printing sheet, and the carriage 15 is thereafter moved so as to laterally shift the ink in a molten state from the thermal head 22. The ink in the molten state is laterally shifted from the thermal head 22 while being pinched between the printing sheet and the ink ribbon 40, and is then cooled and solidified, because in this correction operation the correct pin 26 is pressed against the platen 13 with the ink ribbon 40 and the printing sheet interposed therebetween. The ink has a greater affinity with the ink ribbon 40 than with the printing sheet after the ink has been cooled and solidified, although it has a smaller affinity with the ink ribbon 40 than with the printing sheet during the molten state. Consequently, the ink is removed from the printing sheet by being attached and transferred to the ink ribbon 40 tensioned and separated from the printing sheet at the position downstream of the correction pin 26 by the ribbon feed roller 32 driven and rotated in synchronism with the movement of the carriage 15, thus erasing the character printed on the printing sheet.

Since, at the time of correction, the ink ribbon 40 is separated from the printing sheet when the ink is in a solidified state, the force necessary for separating the ink ribbon 40 at the time of correction is larger than the force necessary for separating the ink ribbon 40 from the printing sheet at the time of printing when the ink is in the molten state. In this arrangement, however, the separation of the ink ribbon 40 is effected by using the frictional force of the ribbon feed roller 32 rotated at a constant speed, and the ink ribbon 40 can therefore be separated by a constant tensile force with improved stability in comparison with the conventional printer in which the ink ribbon 40 is separated by the rotation of the windup bobbin 39 of the ribbon cassette 23. Moreover, because the cover sleeve 36 the outer circumference of which faces the ribbon is formed of a material having a comparatively large friction coefficient, the ink ribbon 40 can be separated from the printing sheet with further improved stability while being prevented from slipping.

In accordance with the present invention, as described above, drawing-out of the ink ribbon 40 from the bobbin 38 and the separation of the ink ribbon 40 from the printing sheet are effected with the pair of ribbon feed rollers 32, 32 rotated at a constant speed, thereby enabling the ink ribbon 40 to be drawn out from the draw-out bobbin 38 with stability and to be separated with stability even at the time of correction when a large tensile force is required for separation.

Figure 5:
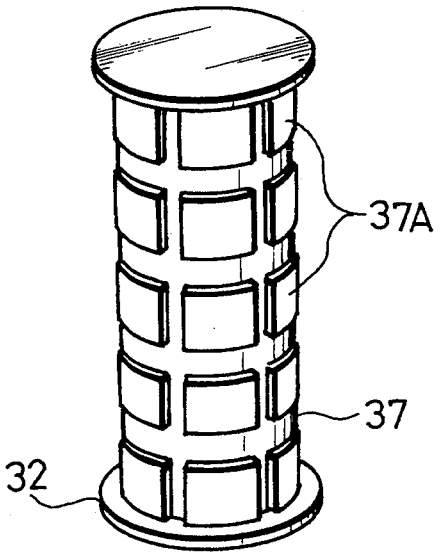
FIG. 5 is a perspective view of another example ribbon feed roller in accordance with the present invention.

Each of the ribbon feed rollers 32, 32 may be formed as a type of roller, such as that shown in FIG. 5, which is covered with rubber 37 in the form of a plurality of blocks 37A, 37A . . . arranged checkerwise to eliminate the influence of dust or extraneous substances and to enable ribbon winding improved in stability and further reduced in the possibility of slippage.

It is to be understood that the present invention is not limited to the above-described embodiment and can be modified as desired in various ways. For example, the present invention may constitute a general type of thermal transfer printer which performs no correction operation or may, of course, constitute an ordinary thermal transfer printer different from the typewriter type. In the above-described embodiment, the correction operation is performed by using the ink ribbon provided for printing. However, the arrangement may alternatively be such that different cassettes, i.e., a printing ribbon cassette and a correction ribbon cassette are provided and the correction operation is performed after replacing the printing ribbon cassette on the carriage with the correction ribbon cassette. In addition, at least one ribbon feed roller 32 may be used in the case where the ribbon cassette is of a type such that the ink ribbon is used by being supplied in only one direction, or at least two ribbon feed rollers 32 respectively disposed on two sides of the ribbon cassette are required in a case where the ink ribbon is used by being supplied alternatively in two directions.

In accordance with the present invention, as described above, the ink ribbon is removed from the printing sheet and is wound up while being tensioned by the ribbon feed rollers rotated at a constant speed, so that it can be separated from the printing sheet with stability, thereby achieving printing of good printing quality while eliminating the risk of entanglement of the ink ribbon. Thus, the present invention is effective in terms of practice.

What is claimed is:

1. A thermal transfer printer comprising:

a carriage;

a motor mounted on the carriage;

a thermal head mounted on the carriage;

a roller driving shaft rotatably mounted on the carriage and connected to the motor, said roller driving shaft having an outer circumferential surface having at least one key;

a windup bobbin drive shaft rotatably mounted on the carriage and connected to the motor;

an ink ribbon cassette mounted on the carriage, the ink ribbon cassette including:

a draw-out bobbin and a windup bobbin rotatably connected to and disposed in the ink ribbon cassette, the windup bobbin including an inner surface receiving the windup bobbin drive shaft, an ink ribbon having a first end wound on the draw-out bobbin and a second end wound on the windup bobbin, the ink ribbon including a first portion disposed adjacent said thermal head, and a cylindrical ribbon feed roller rotatably connected to and disposed in said ink ribbon cassette such that said cylindrical ribbon feed roller contacts a second portion said ink ribbon located between said first portion and said windup bobbin, said cylindrical ribbon feed roller having an inner circumferential surface defining at least one key groove for receiving said at least one key formed on said roller driving shaft;

wherein the thermal printer does not include an idle roller pressing against the cylindrical ribbon feed roller.

2. A thermal transfer printer according to claim 1, further comprising a correction member mounted on said carriage adjacent a third portion of said ink ribbon located between the first portion and the second portion.

3. A thermal transfer printer according to claim 1, wherein said feed roller has a cylindrical sleeve and a cover member for covering an outer circumference of the sleeve.

* * * * *